US008057225B2

(12) United States Patent
Couse et al.

(10) Patent No.: US 8,057,225 B2
(45) Date of Patent: Nov. 15, 2011

(54) SAFETY DOOR FOR ROTARY KILN

(75) Inventors: Derek W. Couse, Victorville, CA (US); Manuel Sandoval, Hesperia, CA (US)

(73) Assignee: Mitsubishi Cement Corporation, Lucerne Valley, CA (US)

( * ) Notice: Subject to any disclaimer, the term of this patent is extended or adjusted under 35 U.S.C. 154(b) by 257 days.

(21) Appl. No.: 12/573,819

(22) Filed: Oct. 5, 2009

(65) Prior Publication Data

US 2010/0021856 A1 Jan. 28, 2010

Related U.S. Application Data

(62) Division of application No. 11/761,246, filed on Jun. 11, 2007, now Pat. No. 7,621,741.

(51) Int. Cl.
*F27D 1/18* (2006.01)

(52) U.S. Cl. ..... 432/250; 432/237; 432/242; 110/173 R

(58) Field of Classification Search ..... 432/3, 56, 432/237, 242, 250; 49/381, 388, 399; 110/173 R, 110/173 B, 173 C See application file for complete search history.

(56) References Cited

U.S. PATENT DOCUMENTS

| | | | | |
|---|---|---|---|---|
| 20,149 | A | | 5/1858 | Devin |
| 313,304 | A | | 3/1885 | Dreyer |
| 1,232,724 | A | | 7/1917 | Seelbach |
| 1,847,822 | A | | 3/1932 | Denton |
| 2,180,797 | A | | 11/1939 | Cockerham |
| 2,197,943 | A | | 4/1940 | Potter |
| 2,254,900 | A | | 9/1941 | Lessmann |
| 2,582,622 | A | | 1/1952 | Craig |
| 2,584,404 | A | | 2/1952 | Webb |
| 2,608,944 | A | | 9/1952 | Norris |
| 2,626,421 | A | | 1/1953 | Lyons |
| 2,714,359 | A | | 8/1955 | Seaver |
| 2,750,185 | A | | 6/1956 | Moore |
| 4,534,132 | A | | 8/1985 | Smith |
| 4,796,543 | A | * | 1/1989 | Barkley ..... 110/173 R |
| 4,854,076 | A | * | 8/1989 | Sieben et al. ..... 49/280 |
| 5,086,716 | A | * | 2/1992 | Lafser, Jr. ..... 110/345 |
| 5,226,774 | A | | 7/1993 | Tutt et al. |
| 5,301,390 | A | | 4/1994 | Cleal |
| 5,394,650 | A | * | 3/1995 | Dean ..... 49/386 |
| 5,540,012 | A | | 7/1996 | Clegg |
| 5,724,899 | A | | 3/1998 | Reese et al. |
| 5,937,583 | A | | 8/1999 | Lamperti |
| 6,000,938 | A | | 12/1999 | Melanowicz |
| 6,676,407 | B2 | | 1/2004 | Largent |
| 7,127,849 | B1 | * | 10/2006 | Gayer ..... 49/386 |
| 7,216,459 | B1 | | 5/2007 | Akkala et al. |

FOREIGN PATENT DOCUMENTS

| | | |
|---|---|---|
| GB | 9421 | 3/1906 |
| SE | 25931 | 6/1906 |

* cited by examiner

*Primary Examiner* — Gregory A Wilson

(74) *Attorney, Agent, or Firm* — Connolly Bove Lodge & Hutz LLP; Billy A. Robbins

(57) ABSTRACT

A safety door for covering openings in a rotary kiln during maintenance operations on the rotary kiln. The door is affixed to the exterior surface of the rotary kiln and includes a hatch pivotally secured at one side edge thereof by a pivot rod to a frame. A plurality of tension coil springs are disposed on the pivot rod and continuously bias the hatch toward the opening with a force of approximately 400 pounds.

8 Claims, 5 Drawing Sheets

SAFETY DOOR FOR ROTARY KILN

RELATED APPLICATIONS

This application is a divisional of application Ser. No. 11/761,246 filed Jun. 11, 2007 now U.S. Pat. No. 7,621,741by the same inventor and assigned to the same assignee. The entire content of this application is hereby incorporated by reference.

BACKGROUND OF THE INVENTION

1. Field of the Invention

This invention pertains generally to high temperature kiln apparatus and more particularly to a safety door for utilization on rotary kilns of the type used in production of cement.

2. Description of the Background Art

Rotating cylindrical kilns are frequently used in the production of cement. The production of cement is a relatively complex process that involves mining and milling the raw materials which are then fed directly into a kiln or fed initially into a heat exchanger (typically a pre-heater or a pre-calciner) which discharges the material into a kiln and then fired to produce "clinkers." The clinkers are subsequently milled and packaged for sale as cement. Such kilns operate at extremely high temperatures and, in some instances, include the injection of combustible waste materials as a source of supplemental heat. These kilns are lined with refractory brick which, in many cases, become coated with hard material during operation. The brick is a wear material that has to be replaced periodically. The brick and hard coating are removed by using a special piece of equipment that hammers the keyed brick out, allowing the material to fall into the bottom of the kiln. Most kilns have bolt on doors that must be removed in order to push the material out onto the ground or into a waiting dump truck. The doors are removed when positioned on top of the kiln and the kiln is then rotated so that the resulting opening or manhole is located on the bottom of the kiln. Once the material is loose and is lying at the bottom of the kiln, equipment is utilized to push the material which has fallen into the bottom of the kiln out through the open manhole.

Once the cleaning of the material lying on the bottom of the kiln has been completed, workers must enter the kiln to measure remaining brick thickness, measure replacement sections, or replace the retainer rings prior to installation of the new brick. During this time, the kiln remains in its rotated position wherein the open manhole is on the bottom portion of the kiln.

With the open manhole in such a position, a hazard is associated with workers entering and exiting the kiln during and after clean up because the open manhole is large enough for most workers to fall through. Most kilns are positioned such that they are on elevated support pedestals thus exposing a worker to a fall greater than the six foot fall allowed by protection equipment. In addition, wearing fall protection equipment inside a kiln is not practical because there are no areas on the internal surface of the kiln for the fall protection equipment to be secured to and because of the large number of people that may be required to be inside the kiln at any given time.

Covering the opening with a solid plate, grating or boards also exposes the worker to the same fall hazard. There is thus a need for a safety door which will automatically cover the opening and which will preclude workers from falling through the open manhole during the required maintenance of the internal surface of the kiln.

SUMMARY OF THE INVENTION

A safety door for covering a manhole formed in a rotary kiln having an exterior surface during kiln maintenance operations which includes a frame which is attachable to the exterior surface of a kiln, a hatch, means for pivotally securing the hatch to the frame and means for continuously biasing the hatch toward the kiln exterior surface with a force sufficient to support at least approximately 400 pounds.

BRIEF DESCRIPTION OF THE DRAWINGS

The advantages of the invention will be brought out in the following portions of the specification where the detailed description is for the purpose of fully disclosing preferred embodiments of the invention without placing limitations thereon. The invention will be more fully understood by reference to the following drawings which are for illustrative purposes only.

DETAILED DESCRIPTION

The present invention is directed to a safety door which is adapted to be affixed to one or more openings existing in the surface of a rotary kiln, particularly one utilized to manufacture cement. The openings are provided in the rotary kiln which is on the order of a 250 feet long, 16 feet in diameter rotating cylinder that is slightly elevated at one end. The openings occur when bolt-on doors have been removed in order to push refractory material which has formed on the interior surface of the kiln out of the kiln. The bolt-on doors are spaced along the kiln typically at 100 feet and 200 feet. Obviously, more bolt-on doors can be provided if such is desired. The safety door is utilized to cover the openings during the time workers are inside the kiln accomplishing required maintenance during or subsequent to removal of the refractory material. The safety door is designed to be attachable to the external surface of the rotary kiln utilizing the same fittings that are used for the bolt-on doors which are removed to allow disposal of the refractory material.

Figure 1:
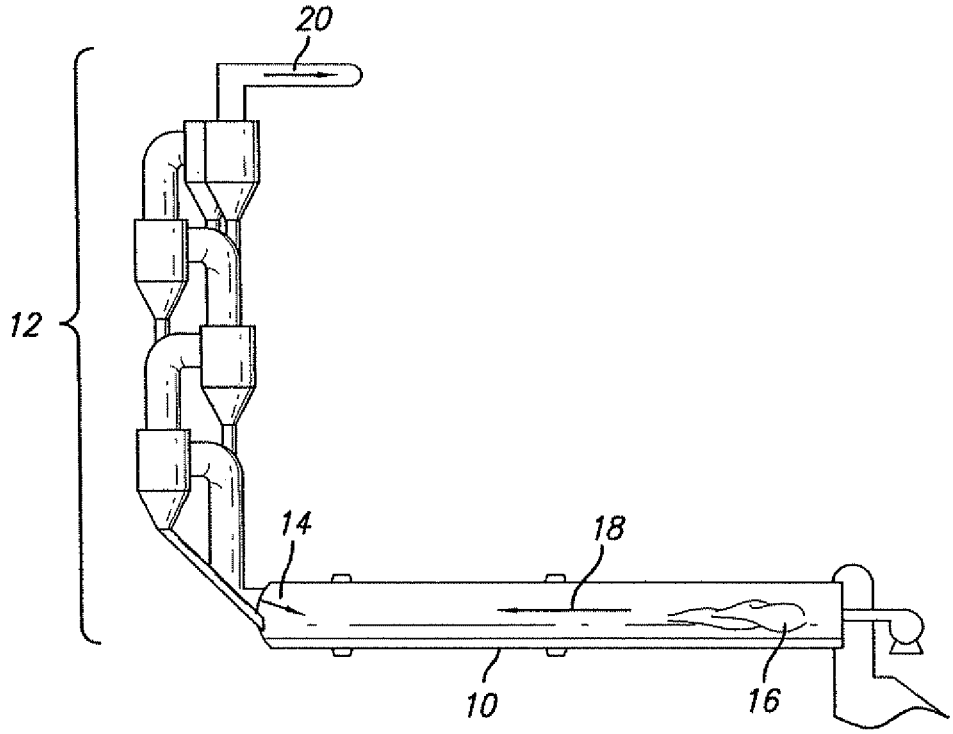
FIG. 1 is a schematic representation of a cement manufacturing plant including a rotary kiln.

FIG. 1 shows in schematic form a rotary kiln having an external surface 10 with a pre-heater or pre-calciner 12 which is used to process raw materials which are then fed as solids into the kiln as shown by the arrow 14. Heat is applied at the opposite end of the kiln as indicated at 16 with combustion gases 18 passing through the kiln and the pre-calciner and out as shown at 20.

Figure 2:
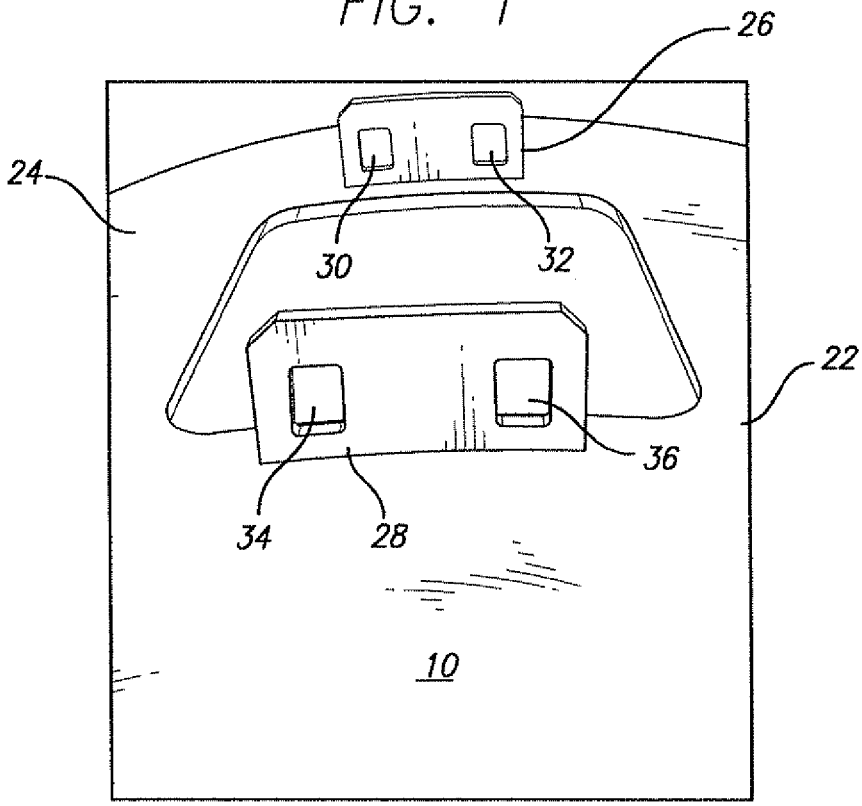
FIG. 2 is a schematic representation of a section of kiln showing the bolt-on door removed there by producing an open manhole.

FIG. 2 shows a portion 22 of the external surface 10 of the kiln as shown in FIG. 1. Provided in the surface 10 is an opening 24 which is formed by removing bolt-on doors (not shown) which are held in place by retainer plates 26 and 28, each of which has openings as shown at 30 through 36 which are adapted to receive fasteners to secure the bolt-on doors to the kiln during normal operation of the kiln to manufacture cement products. Alternatively, a plurality of bolts may be secured to the exterior of the kiln as by welding with the bolt-on doors defining openings to receive the bolts after which nuts are threaded on to the bolts to hold the bolt-on door in place. As will be seen from the description to follow, the retainer plates or the bolts are also used to attach the safety door to cover the opening 24 before or after removal of the refractory material from the rotary kiln.

Figure 3:
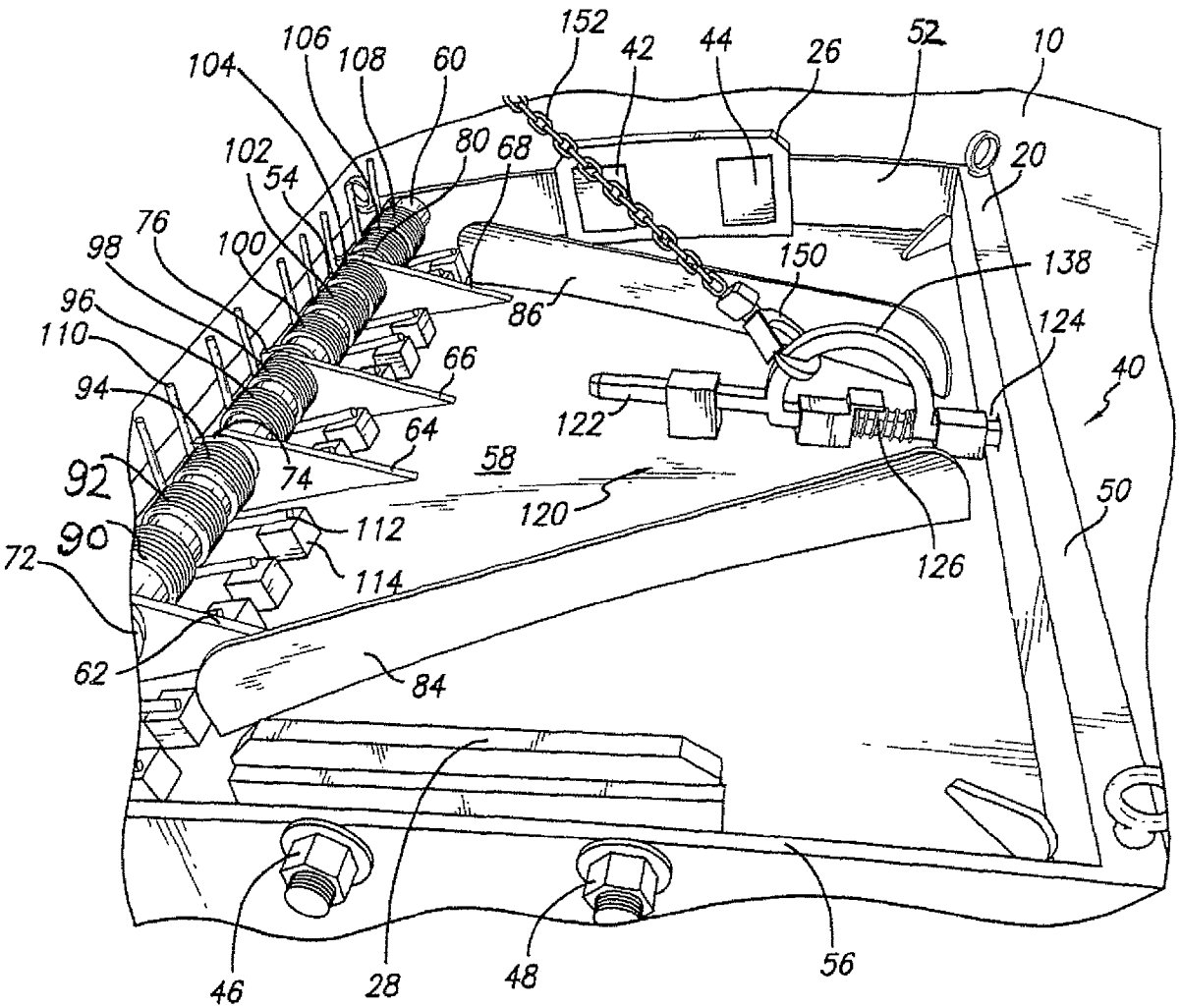
FIG. 3 is a perspective illustration of a safety door constructed in accordance with the principles of the present invention in place on the exterior surface of a rotary kiln.

FIG. 3 shows a safety door 40, which has been secured to the retainer plates 26 and 28 by fasteners 42 through 48. Fasteners 42 through 48 are in the form of bolts passing through the openings 30 through 36 formed in the retainer plates 26 and 28 as above described in conjunction with FIG. 2. The safety door 40 includes a frame having a first side 50, a second side 52, a third side 54 and a fourth side 56. A hatch 58 is pivotally secured to the frame by a pivot rod 60 which extends between the sides 52 and 56 of the frame and is secured thereto. A plurality of mounting flanges 62, 64, 66 and 68 are affixed to the hatch 58 as by welding. As is more clearly shown in FIG. 4, the mounting flanges such as shown at 62 include an opening 70 formed in an upwardly extending portion thereof. The pivot rod 60 passes through the openings 70 formed in the mounting flanges 62 through 68 to pivotally secure the hatch 58 to the frame.

Figure 5:
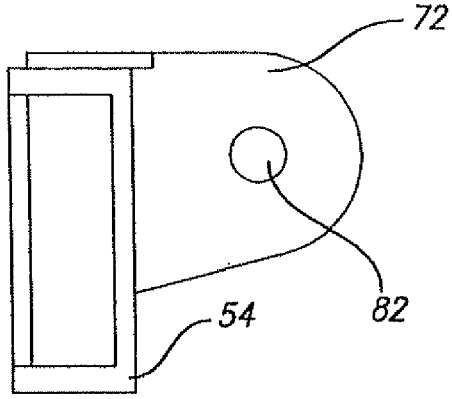
FIG. 5 is a side elevational view of a lug for attaching the door of the present invention to the frame.

Attached to the side 54 of the frame are a plurality of mounting lugs 72, 74, 76 and 80. By reference to FIG. 5, it can be seen that each of the lugs such as the lug 72 is affixed as by welding to the side 54 of the frame. Each of the lugs also includes an opening 82 therethrough through which the pivot rod 60 passes. The utilization of the lugs 72 through 80 provides additional stability for the pivotal attachment of the hatch 58 to the frame.

As seen in FIG. 3, stiffening gussets or beams 84 and 86 are attached to the upper surface of the hatch 58 to provide additional strength and stability to the safety door 40.

It is an important feature of the safety door of the present invention that it be continuously urged toward the surface 10 of the kiln at all times while it is secured to the kiln. It is also important that the biasing of the hatch 58 in this direction be such that a substantial amount of force would be required to move the hatch 58 away from the surface 10 of the kiln. To accomplish this, a plurality of springs 90 through 108 in the form of coil tension springs are positioned upon the pivot rod 60. Each of the springs 90 through 108 has first and second ends as shown at 110 and 112 of the spring 94. The end 110 of the spring 94 rests against the side 54 of the frame. The end 112 of the spring rests against a bearing block 114 which is affixed to the surface of the hatch 58. As is evident from FIG. 3, there exists a sufficient number of bearing blocks, each of which is secured as by welding to the surface of the hatch 58, to accommodate the ends of each of the springs 90 through 108. Although the bearing blocks are shown as individual blocks of metal material welded to the surface of the hatch 58, it should be understood that the bearing blocks may be formed as a plurality of elongated bars of material which would be disposed between the mounting flanges and upon which the ends of several of the springs would bear. It should be recognized by those skilled in the art that as the hatch 58 is rotated about the pivot rod 60 in a counter-clockwise direction as viewed in FIG. 3, the force exerted by the coil springs 90 through 108 increases. When using a torsion spring constructed of 0.375-inch diameter chrome silicon having 6.11 active coils with an outside diameter of 3 inches and an inside diameter of 2.250 inches a force of approximately 1,200 pounds was required to fully open the hatch 58.

Figure 4:
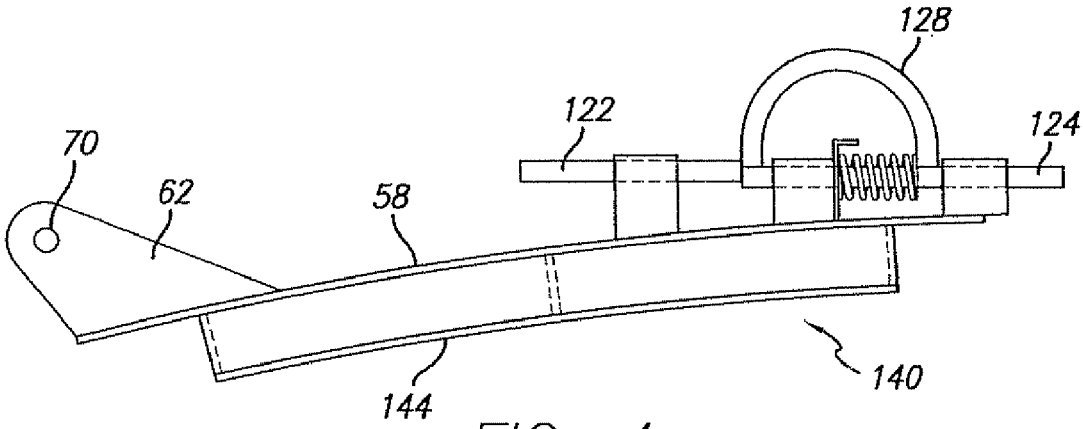
FIG. 4 is a schematic representation partly in cross-section further illustrating features of the safety door of the present invention.
Figure 6:
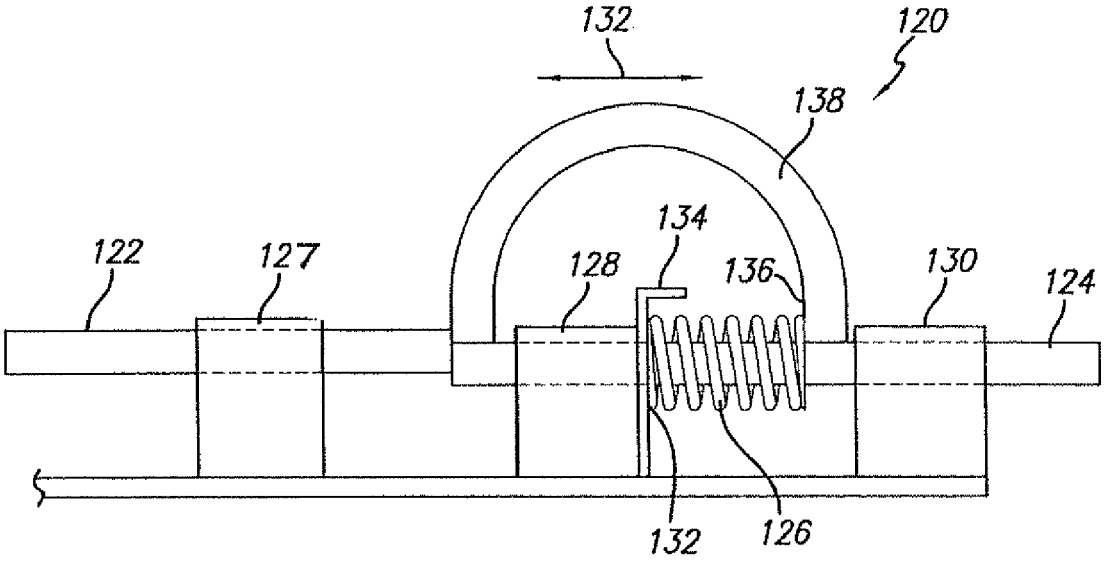
FIG. 6 is a side schematic view of a latching mechanism for use in accordance with the principles of the present invention.
Figure 7:
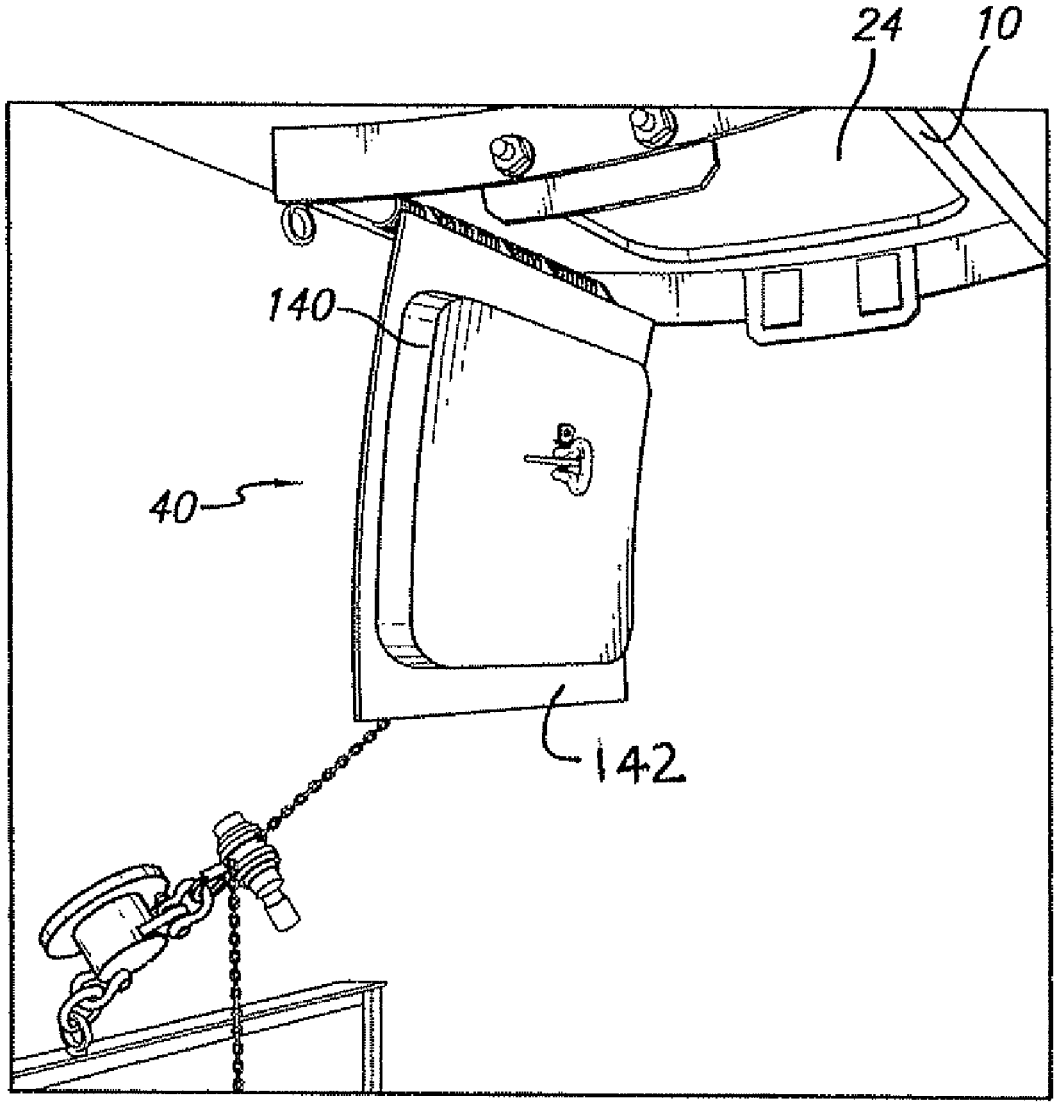
FIG. 7 is a perspective view showing the safety door of the present invention in its full open position.

To positively and securely lock the hatch 58 to the frame of the safety door 40 there is provided a mechanical latch 120. The latch 120 includes an elongated bar 122 which is slideably mounted within appropriate guides that are secured to the hatch 58 as by welding so that an end 124 of the rod extends through an opening provided in the first side 50 of the frame of the door 40. The bar 122 is continuously biased by the spring 126 toward the first side 50 of the frame. The details of construction of the latch 120 are better shown in FIG. 6. As is therein shown, the bar 122 is supported by guides 126, 127 and 130 so as to be reciprocally slideable toward and away from the side 50 of the frame as is indicated by the arrow 132. The spring 126 is seated against a surface 132 of the bracket 134 forming a part of the guide 127. The opposite end of the spring 126 rests against the inner surface 136 of a handle-like member 138, which is secured to the bar 122. The spring 126 is under tension such that it is continuously urging the end 124 of the bar 122 toward the side 50 of the frame. In this manner, the latch when in the closed position securely mechanically locks the hatch 58 to the frame, thus precluding movement of the hatch away from the exterior surface 10 of the rotary kiln. As is indicated in FIGS. 4 and 7, a plug 140 is affixed to the inner surface 142 of the hatch 58. The plug 140 is dimensioned to fit the opening 24 in the rotary kiln such that the inner surface 144 of the plug 140 would be at substantially the same dimensional level as the interior surface of the rotary kiln. By dimensioning the plug 140 in this manner, the interior surface of the rotary kiln will not present obstacles to the workers who are walking thereon to accomplish the maintenance required after the refractory material has been removed from the rotary kiln through the opening 24.

FIG. 7 illustrates the safety door 40 rotated to its fully open position away from the opening 24 in the rotary kiln. Rotation of the door about the pivot rod 60 to the position shown in FIG. 7 is accomplished by attaching a hook or the like 150 to the handle 138. The hook 150 is secured by a chain 152 to a retracting device such as a winch or come along or the like which will apply a force to the chain 152 sufficient to retract the end 124 of the latch 120 from the opening in the first side 50 of the frame. Thereafter, the force is continually applied to cause the hatch 58 to rotate against the force of the springs 90 through 108 to cause the hatch 58 to rotate about the pivot rod 60 to the position as shown in FIG. 7. As above indicated, in a preferred embodiment of the safety door, the force required to fully open the door to the position shown in FIG. 7 was approximately 1,200 pounds as measured by a dynamometer. The door can then be closed by reversing the direction of the winch or come-along allowing the spring tension to close the door and when the force on the handle of the latch is relaxed, the end 124 of the latch bar would then again engage the opening in the first side 50 of the frame, re-engaging the mechanical positive lock.

Figure 8:
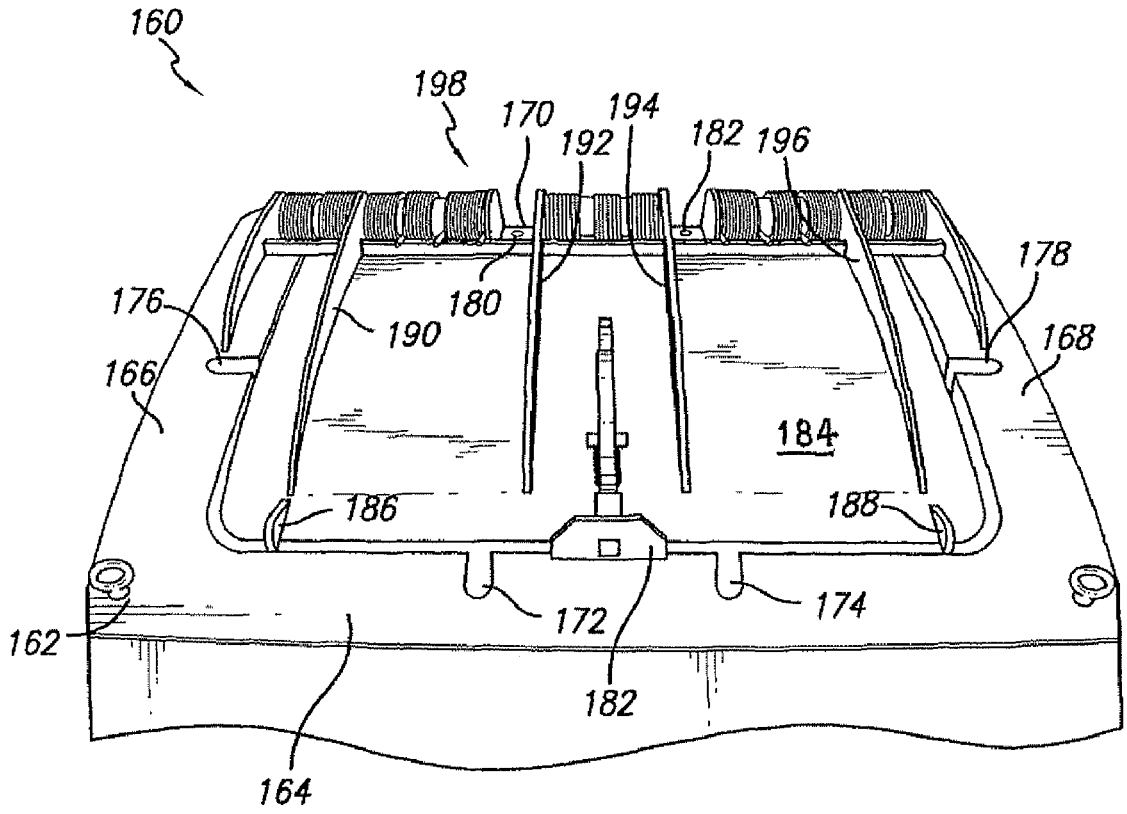
FIG. 8 is a perspective view of an alternative embodiment of a safety door constructed in accordance with the principles of the present invention.

Referring now more particularly to FIG. 8 there is shown an alternative embodiment of a safety door 160 which is constructed in accordance with the principles of the present invention. As is illustrated in FIG. 8, the safety door 160 includes a frame 162 having a first, second, third and fourth sides 164, 166, 168 and 170. Each of the sides define openings which receive bolts which are welded to the exterior surface of the kiln. For example, in the first side 164 there are defined openings in the form of slots 172 and 174, side 166 defines an opening in the form of a slot 176, side 168 defines an opening in the form of a slot 178, while side 170 defines openings 180 and 182. As above indicated, a plurality of bolts are secured to the exterior surface of the rotary kiln in a number and pattern as defined by the openings 172 through 182 in FIG. 8. The bolt on door in place during the cement manufacturing operation of the kiln is held in place by these same bolts and nuts threaded thereon. When the maintenance of the kiln is required to remove the refractory material as above described, the nuts are removed from the bolts and the bolt on door is removed. Thereafter, the safety door as illustrated in FIG. 8 would be fitted over the bolts which would be received in the openings 172 through 182 after which the nuts would be placed on the bolts and secured to secure the frame of the safety door to the exterior of the kiln to thereby cover the opening 24 provided in the kiln. A latch plate 182 is secured to the side 164 of the frame and receives the end of the slidable latch which is substantially the same as that illustrated in FIG. 3 and above described. The safety door 160 includes a hatch 184 which has a pair of stops 186 and 188 attached to the edge thereof, each of which engages the side 164 of the frame to limit the movement of the hatch 184 when it is in place to cover the opening 24 in the exterior surface of the kiln. As shown in FIG. 8, the mounting flanges are included as part of gussets 190, 192, 194 and 196 which also function as stiffening beams for the hatch. As is also shown, a plurality of coil tension springs 198 are disposed on a pivot rod to continuously urge the hatch 184 toward the opening 24. The safety door 160 as shown in FIG. 8 operates substantially the same as the door shown in FIG. 3 and above described.

To determine the integrity of the safety door, a load of approximately 419 pounds was placed upon the door when it was in the closed position but with the mechanical positive lock disengaged. Under these circumstances, the door opened less than 1 inch. The load was increased to 511 pounds and the door opened approximately 3 inches. Under either of these circumstances the opening was not large enough for a person to fall through and the amount of weight applied thereto would be in excess of what would normally occur with a worker walking along the floor formed by the inner surface of the kiln during maintenance operation.

There has thus been disclosed a safety door for use on rotary kilns having openings formed therein to remove refractory materials from the inner surface thereof during the time that continued maintenance is being performed on the interior surface of the rotary kiln as required to repair and replace various sections of the interior of the rotary kiln.

What is claimed is:

1. A safety door for temporarily covering a manhole formed in a rotary kiln by removing a door which is secured to said rotary kiln during normal operation but is removed only during kiln maintenance operations said safety door being secured to said kiln only during said maintenance operations, said safety door comprising:

(a) a hollow cylindrical rotary kiln having an interior and an exterior surface and a diameter large enough for an adult person to stand up inside the kiln;

(b) a frame having first, second, third and fourth sides;

(c) a plurality of openings defined by said frame sides;

(d) a plurality of bolts secured to said kiln exterior surface adjacent said manhole, said bolts being received in said openings defined by said frame sides;

(e) nuts secured to said bolts;

(f) a hatch;

(g) means for pivotally securing said hatch to said frame; and (h) means for continuously biasing said hatch toward said kiln exterior surface with a force sufficient to support approximately four hundred pounds placed on said hatch.

2. The safety door as defined in claim 1 which further includes means for mechanically latching said hatch to said frame.

3. The safety door as defined in claim 2 wherein said means for latching comprises a slideable bar having first and second ends mounted on said hatch, said frame carrying an opening for receiving said first end of said bar and spring means for continuously urging said first end of said bar toward said opening.

4. The safety door as defined in claim 3 wherein said latching means further includes a handle for retracting said first end of said bar from said opening in said frame.

5. The safety door as defined in claim 3 which further includes a latch plate secured to one side of said frame, said latch plate defining said opening for receiving said first end of said bar.

6. The safety door as defined in claim 1 wherein said means for pivotally securing comprises a plurality of mounting flanges secured along a side edge of said hatch, each of said flanges defining an opening therethrough, a pivot rod extending through said openings in said flanges and secured a each end thereof to opposed sides of said frame.

7. The safety door as defined in claim 6 wherein said means for continuously biasing comprises a plurality of coil springs having first and second ends supported on said pivot rod, said first end of each of said springs engaging one side of said frame and said second end of each of said springs engaging said hatch.

8. The safety door as defined in claim 1, wherein said hatch further includes a plug extending therefrom toward said manhole and dimensioned to fit within said manhole and be at substantially the same level as said interior surface when said safety door is latched in place.

* * * * *